United States Patent [19]

Fallen

[11] 4,307,480

[45] Dec. 29, 1981

[54] ROTATING PAD SUPPORT STRUCTURE FOR FLOOR BUFFING MACHINE

[76] Inventor: Burke R. Fallen, 32443 Joyce Way, Union City, Calif. 94587

[21] Appl. No.: 125,839

[22] Filed: Feb. 29, 1980

[51] Int. Cl.[3] ..... A47L 11/40

[52] U.S. Cl. ..... 15/230.18; 51/388

[58] Field of Search ..... 15/230, 230.12, 230.13, 15/230.14, 230.15, 230.16, 230.17, 230.18, 230.19; 51/177, 388

[56] References Cited

U.S. PATENT DOCUMENTS

| | | | |
|---|---|---|---|
| 1,673,160 | 6/1928 | Ross | 15/230.1 X |
| 1,796,787 | 3/1931 | Hatfield | 15/230 X |
| 2,227,588 | 1/1941 | Kemp | 15/230.19 |
| 2,648,178 | 8/1953 | Lyon | 15/230.18 |
| 3,357,141 | 12/1967 | Annis, Jr. | 15/230.14 X |

FOREIGN PATENT DOCUMENTS

| | | | |
|---|---|---|---|
| 686841 | 1/1940 | Fed. Rep. of Germany | 15/230.19 |
| 416055 | 9/1934 | United Kingdom | 15/230.19 |

*Primary Examiner*—Chris K. Moore

*Attorney, Agent, or Firm*—Manfred M. Warren; Robert B. Chickering; Glen R. Grunewald

[57] ABSTRACT

A rotating pad support structure for a floor buffing machine adapted to secure and mount in contact with a floor to be buffed and to rotationally drive a flexible circular floor buffing pad. The structure comprises a drive disc which is normally supported and driven in a horizontal plane and the buffing pad is mounted on the underside of the disc so as to present the bottom working face of the pad to the floor. The disc is specially structured to provide an effective floor buffing area of the pad confined to a peripheral annulus not exceeding about 40% of the area of the pad face.

1 Claim, 2 Drawing Figures

ROTATING PAD SUPPORT STRUCTURE FOR FLOOR BUFFING MACHINE

BACKGROUND OF THE INVENTION

1. Field of Invention:

The invention relates to power-driven, floor buffing machines and more particularly to the pad support structure for the commonly used flexible circular floor buffing pad.

Examples of such floor buffing machines and pad support structures are disclosed in my U.S. Pat. Nos. 3,977,421; 4,069,538; and 4,155,138.

2. Description of Prior Art:

Floor buffing machines of the character described are widely used for the care and polishing of large floor areas such as present in supermarkets, stores and various institutions. Commercial buffing machines commonly use relatively large circular buffing pads, typically 20 inches in diameter, for obtaining good work output; and as explained in my earlier patents above referred to, unique and important advantages are obtained in driving the pad at high speeds up to and well in excess of 1,000 rpm. To accomplish this combination of a relatively large buffing pad and very high speed, substantial drive power is required. Heretofore, the only feasible approach to driving the large pad at high speed has been the use of an internal combustion engine, preferably operated on a liquified gas such as liquid propane for minimum fouling of the atmosphere and permissible use indoors. Electric motor drives are limited by weight and by the power available from conventional electric outlet circuits. Accordingly, it has not been heretofore possible to obtain the desired very high speed operation of a conventional large floor buffing pad with an electric motor drive. One alternative is to tilt the pad to the floor so that only a limited area of the pad is in contact with the floor. Such procedure can cause burning of the floor, will produce premature disintegration of the pad and produce a narrow and non-uniform swath.

SUMMARY OF THE INVENTION

I have found that substantially reduced power requirements can be obtained without significantly detracting from the unique, rapid, high-quality floor finishing accomplished by my earlier machines, by reducing the area of buffer pad/floor contact to a relatively narrow but complete peripheral annulus on the pad. Very good results are obtained when the pad support structure confines the working peripheral annulus to an area not exceeding about 40% of the area of the pad face.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
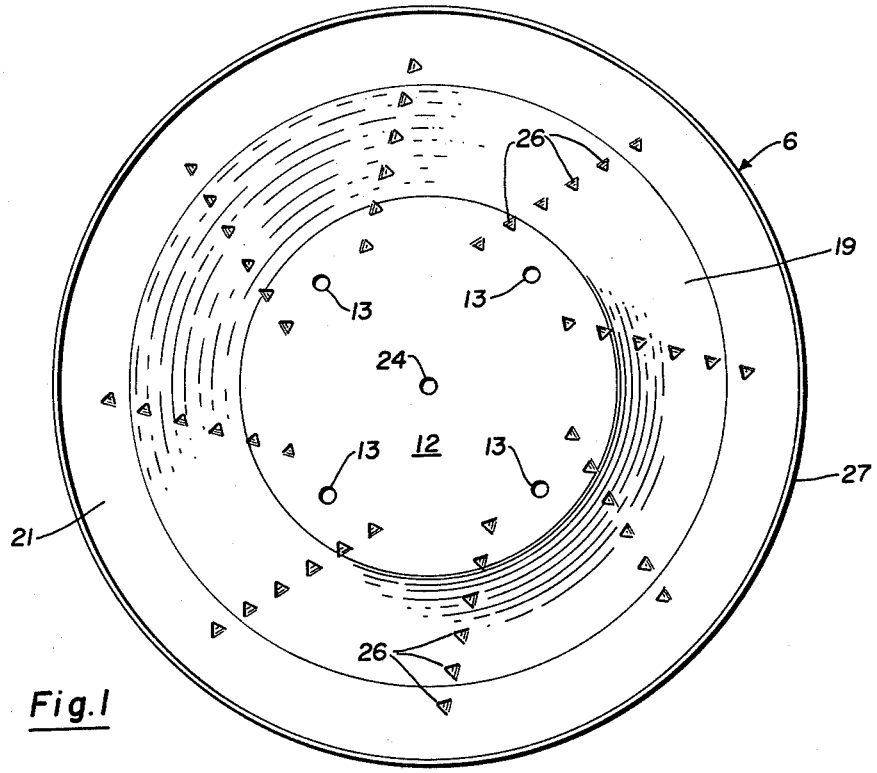
FIG. 1 is a top plan view of a pad supporting and driving disc constructed in accordance with the present invention.
Figure 2:
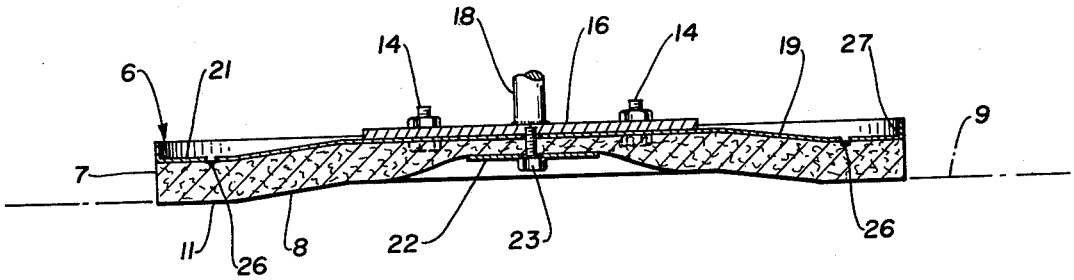
FIG. 2 is a vertical cross-sectional view of the drive disc with a buffing pad secured thereto.

The floor buffing pad support structure of the present invention comprises a drive disc 6 having a generally horizontal position in use, as depicted in FIG. 2, with a flexible circular floor buffing pad 7 mounted on the underside of the disc to present a bottom working face 8 of the pad to the floor 9; and of particular importance is the fact that the disc is structured to provide an effective floor buffing area of the pad confined to a peripheral annulus 11 not exceeding about 40% of the entire area of the pad face 8.

As will be observed from the drawings, disc 6 is formed with a flat central area 12 formed with a plurality of openings 13 for receipt of bolts 14 clamping the disc to a drive plate 16, in turn, mounted perpendicularly on the lower end of a vertically set motor-driven shaft 18 of the buffing machine. The central area 12 of the disc is itself preferably circular in form concentric to shaft 18. Concentrically surrounding area 12 is an inclined disc annulus 19 which terminates at its outer edge in a flat peripheral annulus 21 which is parallel to the central area 12 and axially offset therefrom in the direction of floor 9. The action of the disc structure as described affects a bending of the flexible buffing pad 7 and supporting of its working annulus 11 in substantially planar contact with the floor. The present drive is particularly adapted for use with a conventional porous, fibrous type of buffing pad. The latter may be simply and conveniently fastened to the underside of disc 6 centrally thereof by a washer 22 which is cinched-up against the flexible compressible pad by a bolt 23 passed through a central opening 24 in the disc and threaded into drive plate 16 axially thereof. The snubbing-up of the central portion of the pad by washer 22 causes the pad to conform in its shape generally to the underside of disc 6 thus defining the outer peripheral working annulus 11 of the pad. At the same time, the portions of the working face 8 of the pad interiorly of annulus 11 are supported in spaced relation to floor 9. Preferably, a plurality of teeth 26 are struck out of the sheet from which disc 6 is formed and which will take a bite into the upper surface of pad 7 to aid in the support and driving of the pad.

Disc 6 is preferably formed of lightweight sheet metal such as aluminum so as to obtain good high speed response and is preferably formed with an upturned peripheral flange 27 for reinforcing strength. Typically for a 20 inch driving disc and pad, the central area 12 of the disc will have a diameter of about 10 inches. Annulus 19 will have a radial width of about three inches, and annulus 21 will have a radial width of about two inches. This arrangement will confine the width of the pad annulus 11 to something slightly over two inches. The lightweight aluminum drive disc functions well at elevated speeds to provide dynamic balance and freedom from vibration.

The structure of the present invention as above described provides for a significant reduction in the power requirement to drive the buffing pad at elevated speeds, most desirably in the range of 1400 to 1800 rpm. At the same time, the structure provides for excellent uniform support of the working surface of the pad thus affording improved pad life while maintaining throughout the life of the pad a uniform polishing swath.

What is claimed is:

1. A rotating pad support structure for a high speed floor buffing machine adapted to secure and mount in contact with a floor to be buffed and to rotationally drive in excess of 1,000 rpm a flexible circular floor buffing pad, said structure comprising a drive disc having a generaly horizontal position in use with said pad mounted on the underside thereof to present a working face of said pad to the floor;

said disc having a central drive axis and being formed with surrounding concentric areas being successively at increasing radii axially offset in the direction of the floor, the outermost of said concentric areas bending and supporting said pad into a peripheral annulus into substantially planar contact with the floor; and means connecting said pad and disc and connecting said pad and disc and supporting portions of said pad interior of said annulus in spaced relation to the floor to provide an effective floor buffing area of said pad confined to said peripheral annulus;

said buffing area and peripheral annulus comprising about 40% of the area of said pad face.

* * * * *